US005402977A

United States Patent [19]

Körfgen et al.

[11] Patent Number: 5,402,977

[45] Date of Patent: Apr. 4, 1995

[54] WALL MOUNT FOR BATH FIXTURE

[75] Inventors: Harald Körfgen, Fröndenberg; Ali Karakullukcu, Menden, both of Germany

[73] Assignee: Friedrich Grohe Aktiengesellschaft, Hemer, Germany

[21] Appl. No.: 116,915

[22] Filed: Sep. 7, 1993

[30] Foreign Application Priority Data

Oct. 22, 1992 [DE] Germany ..... 42 35 660.1

[51] Int. Cl.[6] ..... A47F 5/00

[52] U.S. Cl. ..... 248/309.1; 211/89; 248/316.1

[58] Field of Search ..... 248/309.1, 314, 111, 248/316.1, 316.7, 221.2, 221.4, 222.1, 224.4, 225.1, 231.9, 205.3, 205.4, 205.5, 205.6, 201, 635, 113; 211/89, 63; 4/601, 605

[56] References Cited

U.S. PATENT DOCUMENTS

| | | | |
|---|---|---|---|
| 2,098,997 | 11/1937 | Bramming | 248/222.1 |
| 2,177,504 | 10/1939 | Thompson | 248/205.5 X |
| 2,278,075 | 3/1942 | Hecht | 248/205.5 |
| 2,640,671 | 6/1953 | Grady | 248/222.1 |
| 2,795,834 | 6/1957 | Szoke | 248/113 |
| 2,968,460 | 1/1961 | Von Dusen | 248/205.3 |
| 3,826,454 | 7/1974 | Zieger . | |
| 4,219,178 | 8/1980 | Assion | 211/89 X |
| 4,711,135 | 12/1987 | Horwichi et al. | 248/635 |
| 4,838,506 | 6/1989 | Cooper | 248/309.1 X |
| 5,076,523 | 12/1991 | Wong | 248/222.1 |

FOREIGN PATENT DOCUMENTS

| | | |
|---|---|---|
| 058405 | of 0000 | European Pat. Off. . |
| 2930518 | of 0000 | Germany . |
| 3132855 | of 0000 | Germany . |
| 4124354 | of 0000 | Germany . |

*Primary Examiner*—Ramon O. Ramirez
*Assistant Examiner*—Korie H. Chan
*Attorney, Agent, or Firm*—Herbert Dubno; Andrew Wilford

[57] ABSTRACT

An assembly for mounting a bath fixture to a wall having a surface formed with a plurality of holes opening at the surface has respective anchors seated in the holes, a bracket adapted to hold the fixture and having a face turned toward the wall at the holes, a disk of elastomeric material between the bracket face and the wall surface and formed with throughgoing apertures aligned with the wall holes, and respective screws extending through the bracket and through the disk apertures and securing the bracket to the wall with the disk compressed between the bracket and the wall. The elastomeric disk, which has a Shore A hardness of about 65 and a thickness of about 1 mm and may be made of closed-cell sponge rubber, prevents water from getting into the space behind the bracket, in particular into the region around the hole in the wall.

6 Claims, 1 Drawing Sheet

WALL MOUNT FOR BATH FIXTURE

FIELD OF THE INVENTION

The present invention relates to a wall mount. More particularly this invention concerns such a mount used to secure a bath fixture like a shower to a wall in a tub or shower enclosure.

BACKGROUND OF THE INVENTION

In order to mount, for instance, a telephone-type hand shower on the wall so that it can be used like a stationary shower head, it is standard to provide a separate fork-shaped bracket that is fixed to the shower wall. Since the walls are typically made of tile, it is necessary to bore at least one hole in the wall, fit a lead or plastic anchor therein, and then secure the bracket to this anchor by a screw.

This type of installation creates a potential leak site in the otherwise waterproof wall, a place where water can get past the waterproof covering formed by the tile to the underlying structure which could be damaged by water. Since the wall is of a hard ceramic, it is unlikely that the hard metal or plastic bracket will fit it accurately, so that some water will surely get between the bracket and the wall. Furthermore the fact that this area is closed means that the water that gets behind the bracket is trapped just at that location where it can work its way into the hole in the wall.

OBJECTS OF THE INVENTION

It is therefore an object of the present invention to provide an improved wall-mount assembly for a bath fixture.

Another object is the provision of such an improved wall-mount assembly for a bath fixture which overcomes the above-given disadvantages, that is which eliminates the mounting hole behind the bracket as a potential leak site.

SUMMARY OF THE INVENTION

An assembly for mounting a bath fixture to a wall having a surface formed with a plurality of holes opening at the surface has according to the invention respective anchors seated in the holes, a bracket adapted to hold the fixture and having a face turned toward the wall at the holes, a disk of elastomeric material between the bracket face and the wall surface and formed with throughgoing apertures aligned with the wall holes, and respective screws extending through the bracket and through the disk apertures and securing the bracket to the wall with the disk compressed between the bracket and the wall.

Thus the elastomeric disk, which according to this invention has a Shore A hardness of about 65 and a thickness of about 1 mm and may be made of closed-cell sponge rubber, prevents water from getting into the space behind the bracket, in particular into the region around the hole in the wall. The disk is engineered to present considerable sliding friction both on the wall surface and back bracket face to further enhance the hold of the bracket on the wall.

In accordance with a further feature of the invention the disk has a face turned toward the wall surface and formed around each aperture with an annular ridge. It also has a face turned away from the wall surface and formed around each aperture at the respective ridge with an annular groove. The face of the disk turned toward the wall surface can be provided with a layer of adhesive adhering it to the wall surface. Furthermore the disk is usable as a template for marking and/or drilling the holes in the wall.

The bracket of the invention has a back part formed with the bracket face, a front part with a skirt engaging backwardly over the back part around the disk and having a rear edge directly engaging the wall surface, and a screw securing the front part to the back part. Thus this skirt itself directly engages the wall around the outer periphery of the bracket, completely concealing the disk which nonetheless is compressed between the planar back face of the bracket and planar wall surface to prevent leakage at the critical hole region.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
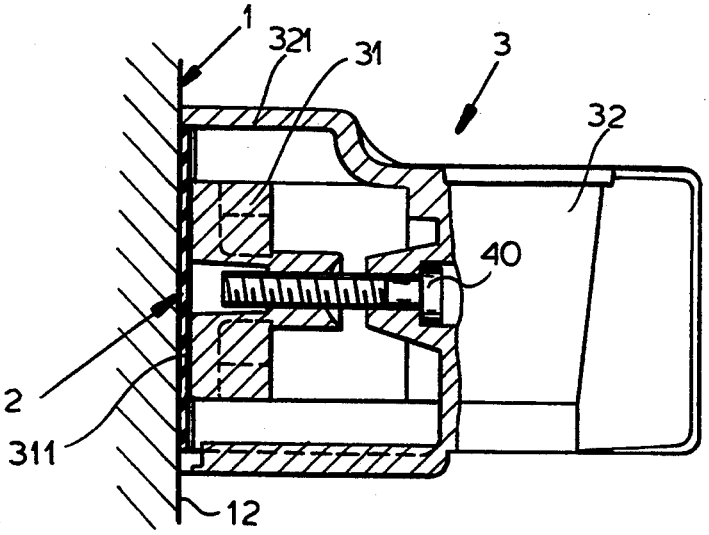
FIG. 1 is a vertical section through the mount assembly according to the invention.
Figure 4:
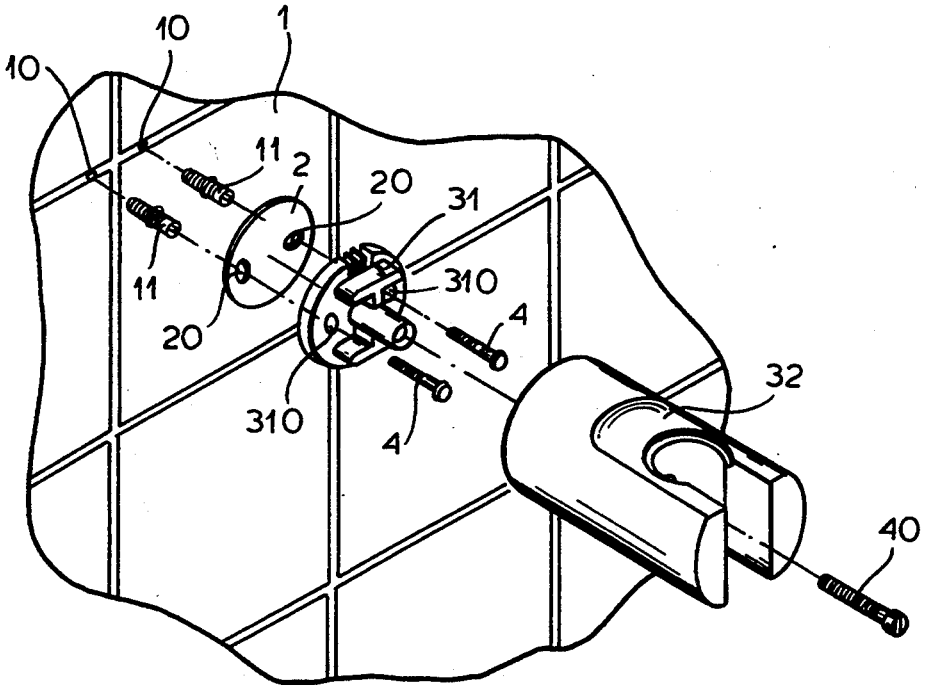
FIG. 4 is a perspective exploded view of the assembly of FIG. 1.

As seen in FIGS. 1 and 4 a ceramic-tiled wall 1 has a planar surface 12 into which are bored two cylindrical holes 10, here shown at the joint between adjacent tiles. These holes 10 are fitted with standard screw anchors 11 of lead, composite material, or plastic.

A wall bracket 3 has an inner part 31 secured by screws 4 to the anchors 11 and an outer part 32 formed as a shower-holding fork and secured by a screw 40 to the inner part 31. This inner part 31 is formed with two slot holes 310 extending at right angles to each other and has a planar back face 311.

According to the invention a thin circular disk 2 of closed-cell 1 mm-thick sponge rubber of a Shore A hardness of 65 is sandwiched between the back face 311 of the part 31 and the surface 12 of the wall 1. This disk 2 is formed with two holes 20 identical to the holes 310 and is provided on its rear face with a layer of contact adhesive, normally covered by a removable tear-off sheet prior to installation. Another such layer may also be provided on its front face to hold the part 31 until the screws 4 are seated and to further enhance the grip of the disk 2 on the backet 3. Thus this disk 2 is compressed between the part 31 and wall 1 and prevents moisture from getting behind the part 1 and to the location of the holes 10.

In practice the disk 2 is used as a template for marking and drilling the holes 10. It can be adhered to the wall in the desired location, making the drilling fairly easy.

Furthermore according to the invention the front part 31 has a cylindrically tubular backwardly extending skirt 321 that is of an inner diameter generally equal to the outer diameter of the disk 2 so that when the screw 40 is tightened, the back edge of the skirt 321 will directly engage the surface 12 around the disk 2, making a very neat appearance for the assembly.

Figure 2:
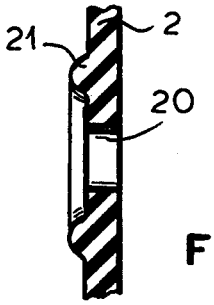
FIGS. 2 and 3 are vertical sections through two alternative seal disks according to the invention.
Figure 3:
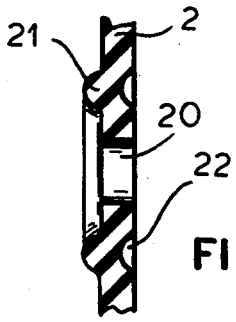

FIG. 2 shows how the disk 2 can be formed with an annular ridge 21 around each of the holes. Such a ridge 21 enhances the seal in this critical hole region. For ease of manufacture as seen in FIG. 3, the disk 2 may also be formed with a groove 22 on its front face directly opposite the ridge 21.

We claim:

1. An assembly for mounting a bath fixture to a wall having a surface formed with a plurality of holes opening at the surface, the assembly comprising:

respective anchors seated in the holes;

a bracket adapted to hold the fixture and having a face turned toward the wall at the holes and formed with a pair of throughgoing holes spaced to align with the wall holes;

a disk of elastomeric material between the bracket face and the wall surface and formed with throughgoing apertures spaced to align with the wall and bracket holes, the disk having a back face having an annular ridges around each of the apertures and an oppositely directed front face; and respective screws extending through the bracket holes and through the disk apertures and securing the bracket to the anchors with the disk compressed between the bracket and the wall and the annular ridges of the back face directly engaging the wall surface all around the respective wall holes and the front face directly engaging the bracket face all around the bracket holes to prevent leakage.

2. The bath-fixture wall-mount assembly defined in claim 1 wherein the disk has a Shore A hardness of about 65 and a thickness of about 1 mm.

3. The bath-fixture wall-mount assembly defined in claim 1 wherein the disk is of sponge rubber.

4. The bath-fixture wall-mount assembly defined in claim 1 wherein the disk front face has an annular groove formed around each aperture at the respective ridge.

5. The bath-fixture wall-mount assembly defined in claim 1 wherein the disk back face is provided with a layer of adhesive adhering the disk to the wall surface.

6. The bath-fixture wall-mount assembly defined in claim 1 wherein the bracket has a back part formed with the bracket face, a front part with a skirt engaging backwardly over the back part around the disk and having a rear edge directly engaging the wall surface, and a screw securing the front part to the back part.

* * * * *